US007626324B2

(12) United States Patent
Yamatoda et al.

(10) Patent No.: US 7,626,324 B2
(45) Date of Patent: Dec. 1, 2009

(54) IMAGE DISPLAY APPARATUS

(75) Inventors: Takeshi Yamatoda, Atsugi (JP); Akihiko Yamano, Sagamihara (JP)

(73) Assignees: Canon Kabushiki Kaisha, Tokyo (JP); Kabushiki Kaisha Toshiba, Tokyo (JP)

( * ) Notice: Subject to any disclaimer, the term of this patent is extended or adjusted under 35 U.S.C. 154(b) by 188 days.

(21) Appl. No.: 11/951,766

(22) Filed: Dec. 6, 2007

(65) Prior Publication Data

US 2008/0157650 A1 Jul. 3, 2008

(30) Foreign Application Priority Data

Dec. 27, 2006 (JP) ..... 2006-352357
Nov. 26, 2007 (JP) ..... 2007-304424

(51) Int. Cl.
*H01J 1/62* (2006.01)

(52) U.S. Cl. ..... 313/495; 313/310

(58) Field of Classification Search ..... 313/495, 313/309–310, 336, 351
See application file for complete search history.

(56) References Cited

U.S. PATENT DOCUMENTS 5,734,361 A 3/1998 Suzuki et al. ..... 345/74
5,905,335 A 5/1999 Fushimi et al.
6,494,757 B2 12/2002 Yamazaki et al.
6,580,407 B1 6/2003 Suzuki et al. ..... 345/74.1
6,809,469 B1 10/2004 Ito et al.
6,963,159 B2 11/2005 Fushimi
6,992,447 B2 1/2006 Fushimi et al.
2005/0264166 A1 12/2005 Ando
2005/0285503 A1 12/2005 Ando ..... 313/495
2006/0138926 A1 6/2006 Yamatoda et al. ..... 313/310

FOREIGN PATENT DOCUMENTS

EP 1 603 147 12/2005
JP 8-315723 11/1996
JP 2000-311608 11/2000
JP 2000-311632 11/2000
JP 2003-223857 8/2003
JP 2003-223858 8/2003
JP 2003-282000 10/2003
JP 2003-331761 11/2003
JP 2006-19253 1/2006

*Primary Examiner*—Vip Patel
(74) *Attorney, Agent, or Firm*—Fitzpatrick, Cella, Harper & Scinto

(57) ABSTRACT

An image display apparatus of smaller beam deviation is provided by making smaller the absolute value of an angle formed by an initial velocity vector of an electron emitted from the first electron-emitting devices closest to a spacer 100 and a line parallel to the longitudinal direction of a spacer 100, rather than the absolute value of an angle formed by an initial velocity vector of an electron emitted from the second electron-emitting devices secondary closer to the spacer 100 and the line parallel to the longitudinal direction of the spacer 100.

3 Claims, 17 Drawing Sheets

IMAGE DISPLAY APPARATUS

BACKGROUND OF THE INVENTION

1. Field of the Invention

The present invention relates to an image display apparatus.

2. Description of the Related Art

Recently, flat panel displays which use electron-emitting devices have been studied actively. The flat panel displays have a rear plate equipped with electron-emitting devices, a face plate equipped with light-emitting members such as phosphors, and a panel obtained by joining the rear plate and face plate via a frame. Since an atmosphere of reduced pressure is maintained in the panel, the panel contains a spacer which serves as a support structure which can withstand atmospheric pressure to prevent the panel from being broken by the atmospheric pressure. It is known that the spacer, which is exposed to electron and other radiation reflected by the face plate, has its surfaces electrostatically charged, affecting trajectories of electron beams from the electron-emitting devices. To solve this problem, the spacer has been designed with various features. Specifically, antistatic coatings are applied to a spacer surface or surface geometry of the spacer is made concavo-convex. Together with the antistatic techniques, inventive approaches are discussed to make electrostatic charge on the spacer unnoticeable by controlling the trajectories of electron beams from electron-emitting devices in the vicinity of the spacer.

Patent document 1 describes a spacer manufacturing method by means of hot drawing and discloses a method for efficiently producing a spacer with a concavo-convex pattern formed on a surface.

Patent document 2 discloses that the resistance value of a high resistance film on a spacer surface has dependency on the direction of film formation.

Patent document 3 discloses that the shorter the distance between a spacer and an electron source, the greater the impact on electron-beam trajectories. This means that the narrower the pixel pitch, the larger the deviation in beam incident position to be corrected.

Patent document 4 discloses that beam position near a spacer is defined by height of scanning wirings.

Patent document 5 discloses that a concavo-convex pattern is formed on a spacer surface for electrostatic control and that groove shape is determined in such a way as to reduce incident angle dependency of a secondary electron emission coefficient δ of the spacer surface.

Patent documents 6 and 7 disclose that a concavo-convex pattern is formed on a spacer surface, that the concavo-convex pattern has a pitch distribution, and that a resistance distribution is produced on the spacer surface by the pitch distribution.

Patent document 8 discloses a technique for controlling trajectories of electron beams from surface conduction electron-emitting devices, each of which has a pair of device electrodes, near a spacer by inclining opposing faces of the device electrodes in a direction perpendicular to the longitudinal direction of the spacer.

<Patent document 1> Japanese Patent Application Laid-open No. 2000-311608 (U.S. Pat. No. 6,494,757)

<Patent document 2> Japanese Patent Application Laid-open No. 2003-282000

<Patent document 3> Japanese Patent Application Laid-open No. 2003-331761 (U.S. Pat. No. 6,992,447)

<Patent document 4> Japanese Patent Application Laid-open No. H08-315723 (U.S. Pat. No. 5,905,335)

<Patent document 5> Japanese Patent Application Laid-open No. 2000-311632 (U.S. Pat. No. 6,809,469)

<Patent document 6> Japanese Patent Application Laid-open No. 2003-223858 (U.S. Pat. No. 6,963,159)

<Patent document 7> Japanese Patent Application Laid-open No. 2003-223857

<Patent document 8> Japanese Patent Application Laid-open No. 2006-019253 (U.S. Patent Publication 2005/264166)

An image display apparatus illustrated in FIG. 2 includes a rear plate 81 which has matrix wirings and electron-emitting devices, a face plate 82 which has irradiated sections facing the respective electron-emitting devices, and a support frame 86, together forming an envelope 90. The image display apparatus, in which a high vacuum is maintained, has a spacer 100 to protect inner space from atmospheric pressure.

FIG. 3A illustrates a cross section as viewed from Y-side wires 89 near the spacer. The spacer is installed, being sandwiched between the Y-side wires on the side of the rear plate and an abutting member 131 on the side of the face plate. Because of an electric field formed by the spacer, electron-beam trajectories near the spacer differ from electron-beam trajectories distant from the spacer. Due to the difference in the electron-beam trajectory, the electron beams near the spacer and electron beams distant from the spacer differ in incident position of electron beams on the face plate. Consequently, density of light-emitting points changes near the spacer, causing bright lines or dark lines to be recognized in images and thus resulting in degradation of image quality.

FIG. 4 illustrates how electron beams near the spacer deviate in incident position of electron beams due to the electric field of the spacer. Effect of the electric field on electron-beam trajectories increases with decreasing distance from the spacer, and decreases with increasing distance from the spacer.

Recent studies by the inventors have suggested that electron beam deviations near the spacer are roughly classified into three types. The first is "initial beam deviation," the second is "temperature-difference-dependent beam deviation," and the third is "charging-dependent beam deviation." The "initial beam deviation" is deviation in incident position of electron beams caused by potential distribution on a spacer surface and attributable only to potential difference between the face plate and rear plate. The "temperature-difference-dependent beam deviation" is deviation in incident position of electron beams caused by changes in the resistance value of a high-resistance potential regulation film on the space surface due to temperature difference between the face plate and rear plate. The "charging-dependent beam deviation" is deviation in incident position of electron beams caused by charging of the spacer surface which occurs when electron beams reflected by a metal back reach the spacer surface. Charging can be either positive or negative depending on a secondary electron emission coefficient of the spacer surface. Thus, the electron beam deviation near the spacer results from superimposition of the three types.

To correct the beam deviation, patent document 3 describes a method for correcting deviation in the incident position of electron beams by increasing the pixel pitch near the spacer according to the deviation in the incident position. Also, patent document 4 describes a method for correcting deviation in the incident position of electron beams by adjusting height of a member which abuts the spacer. Although these methods can correct the "initial beam deviation" to some extent, the methods cannot correct the "temperature-difference-dependent beam deviation" and "charging-dependent beam deviation" sufficiently.

In correcting beam deviation near the spacer, a method which forms concavo-convexity on the spacer surface covers a wide range of correction and can solve the initial beam deviation and charging-dependent beam deviation out of the three types of beam deviation. With the hot drawing process described in patent document 1, a spacer with a striped concavo-convex pattern formed on a longitudinal surface can be produced easily. This technique can also be used for examples of the present invention. To minimize charging of the spacer using a concavo-convex pattern on the spacer surface, it is necessary to consider the secondary electron emission coefficient δ, which is the value obtained by dividing the number of emitted electrons by the number of incident electrons in a unit area on the spacer surface. When δ is 1, the number of emitted electrons equals the number of incident electrons, and thus the spacer is not electrically charged. When δ is larger than 1, the proportion of the emitted electrons increases, causing the spacer surface to be charged positively. When δ is smaller than 1, the proportion of the emitted electrons decreases, causing the spacer surface to be charged negatively. The value of δ depends on material of an antistatic film on the spacer surface, surface geometry of the spacer, and an incident angle of the incoming electrons. If it is assumed that the incident angle is 0 when the electrons are incident perpendicularly on the spacer surface, the secondary electron emission coefficient increases with increases in the incident angle. Electrons are rarely incident perpendicularly on the spacer and are incident from the side of the face plate or rear plate in many cases. Thus, when the spacer surface is flat, δ becomes far larger than 1, tending to cause the spacer surface to be charged positively. Conversely, when the spacer surface contains concavo-convexity forming deep grooves, the incident angle can be kept low in the grooves and thus δ can be reduced. Based on these principles, patent document 5 describes a method for reducing charging by minimizing δ through formation of a concavo-convex pattern on the spacer. This method can reduce the "charging-dependent beam deviation," but the concavo-convex pattern on the spacer surface also affects resistance distribution on the spacer surface and thus the "initial beam deviation," making it difficult to control both types of deviation as desired.

The principle by which the "initial beam deviation" is corrected using a concavo-convexity distribution consists in producing a resistance distribution on the spacer surface using the concavo-convexity distribution and thereby producing a desired potential distribution. That is, since creepage distance varies with concavo-convexity, resistance on the spacer surface can be distributed according to the concavo-convex pattern. This technique is described in patent documents 6 and 7.

Incidentally, as a technique for correcting beam position, patent document 8 discloses a technique for ingeniously adjusting orientation of a pair of device electrodes. Specifically, the technique controls trajectories of electron beams from surface conduction electron-emitting devices, each of which has a pair of device electrodes, near a spacer by inclining opposing faces of the device electrodes in a direction perpendicular to the longitudinal direction of the spacer. Hereinafter, the device electrodes whose opposing faces are inclined in a direction perpendicular to the longitudinal direction of the spacer will be referred to as "inclined device electrodes." However, an image display apparatus with a narrow pixel pitch results in reduction in drift distances and reduction in an angle of inclined device electrodes, which are important elements of inclined device electrodes, reducing amounts of their correction.

In view of the conventional problem described above, an object of the present invention is to implement a higher-quality image display apparatus by correcting differences in beam incident position resulting from differences in spacing distance from a spacer.

SUMMARY OF THE INVENTION

To solve the above problem, the present invention has features described below.

The present invention provides an image display apparatus comprising: a rear plate including thereon first and second electron-emitting devices each having a pair of device electrodes disposed in opposition to each other sandwiching a gap therebetween, and an electron-emitting region between the pair of device electrodes; a face plate having a phosphor; and a plate shaped spacer disposed between the rear plate and the face plate, closer to the first electron-emitting device rather than the second electron-emitting device, wherein a longitudinal direction of the gap of the first electron-emitting device is inclined at a first inclination angle to a direction perpendicular to a longitudinal direction of the spacer, a longitudinal direction of the gap of the second electron-emitting device is inclined at a second inclination angle to the direction perpendicular to the longitudinal direction of the spacer, and the second inclination angle is larger than the first inclination angle.

Further features of the present invention will become apparent from the following description of exemplary embodiments with reference to the attached drawings.

DESCRIPTION OF THE EMBODIMENTS

As a result of earnest studies, the inventors newly found that depending on pixel pitch, electron-emitting devices which are the second closest to the spacer are affected by charging of the spacer more greatly than the electron-emitting devices closest to the spacer. The present invention is based on this new finding. Hereinafter, the electron-emitting devices closest to the spacer may be referred to as the "first closest devices" or the "closest devices." On the other hand, the electron-emitting devices which are the second closest to the spacer may be referred to as the "second closest devices." It is believed that our finding can be explained by the facts that the spacer is positively charged on the face plate side and negatively charged on the rear plate side and that there are wiring and other protruding structures on the rear plate while the face plate is relatively flat. More specifically, the electron beams emitted from the first closest devices are affected by both the positive and negative charges on the spacer surface. Regarding the electron beams emitted from the second closest devices, the effect of the negative charge on the rear plate side of the space is reduced by potential shielding of the wiring, but the positive charge on the face plate side of the space affects the spacer directly. In this way, since the first closest devices and second closest devices are affected differently by the charging of the spacer, it is very difficult to provide a spacer which can control electron-beam trajectories of both the first and second closest devices as desired. Thus, it is important to provide a technique which can control the first closest devices and second closest devices separately in a manner different from conventional ones. The present invention is based on this new knowledge.

Figure 2:
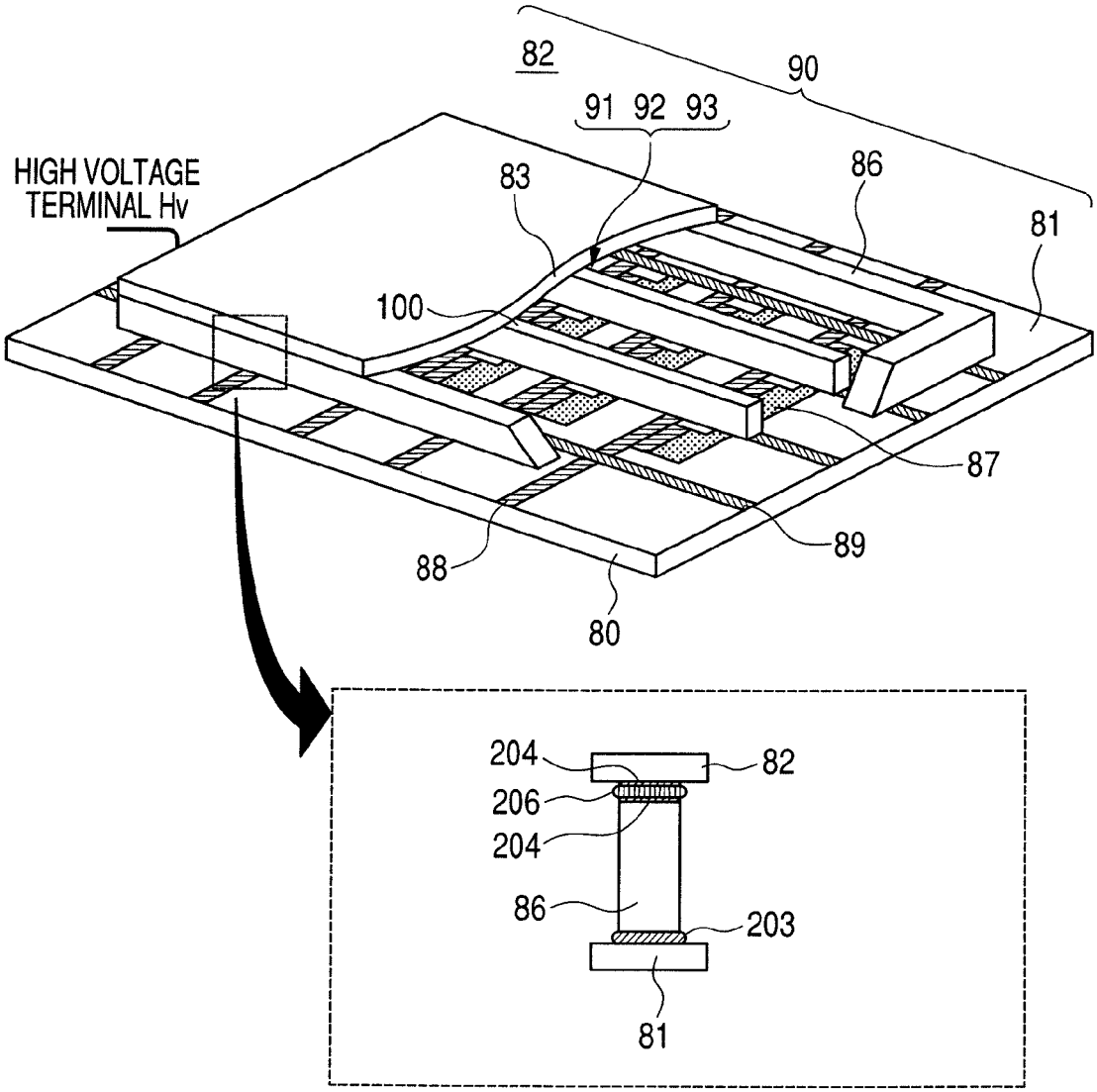
FIG. 2, which illustrates a structure of an image display apparatus according to the present invention, is a partially cutaway perspective view of the image display apparatus and an enlarged sectional view of a sealed portion of the image display apparatus.

Next, an exemplary embodiment of the present invention will be described. FIG. 2 is a partially cutaway perspective view of the image display apparatus according to the present invention. As illustrated in FIG. 2, the image display apparatus includes a rear plate 81 that has X-side wires 88 and Y-side wires 89 (scanning wirings) arranged in a matrix and electron-emitting devices, a face plate 82 placed opposite the rear plate and equipped with irradiated sections, and spacers 100 erected between the rear plate and the face plate, all of which are enclosed in an envelope 90 under a desired vacuum atmosphere. The inside of the envelope must be kept under a vacuum needed for continuous driving of the electron-emitting devices 87.

The matrix wirings on the rear plate need to have resistance low enough to drive an electron source. However, the X-side wires and Y-side wires illustrated in FIG. 2 do not need to have the same resistance value. To avoid electrical contact between the X-side wires and Y-side wires, an insulating layer is installed between the two types of wire. The insulating layer needs to be thick enough to avoid crosstalk between the two types of wire. The spacers are placed in abutment with the upper of the two types of wire, and preferably abut surfaces are increased as much as possible to make an electric field near the electron-emitting devices uniform.

According to the present invention, desirably the electron-emitting devices are surface conduction electron-emitting devices. This is because the present invention uses curvilinearity of electron beam propagation, which is a feature of the surface conduction electron-emitting devices.

Figure 3A:
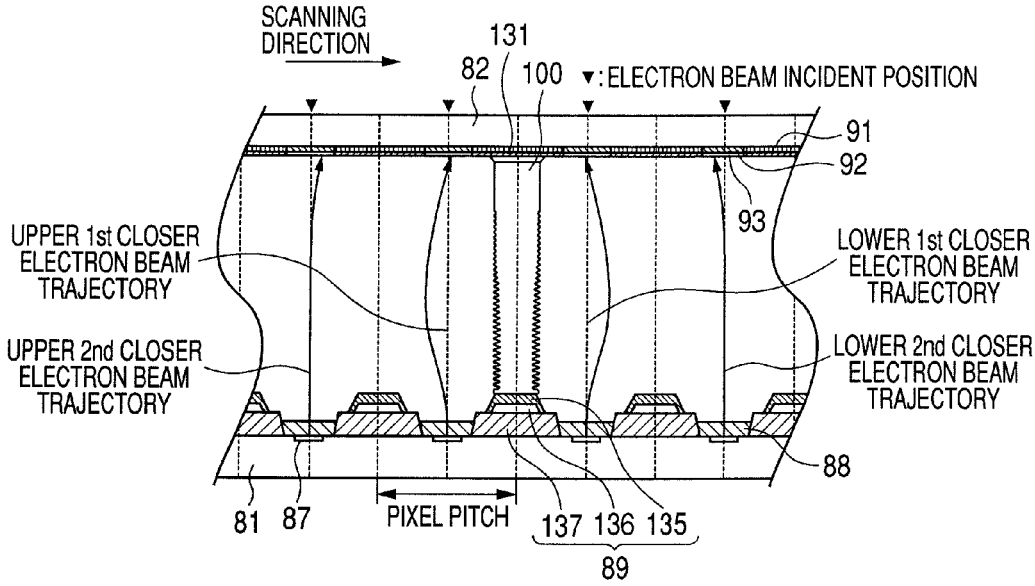
FIG. 3A is a diagram illustrating a structure near a spacer and electron beam trajectories.
Figure 3B:
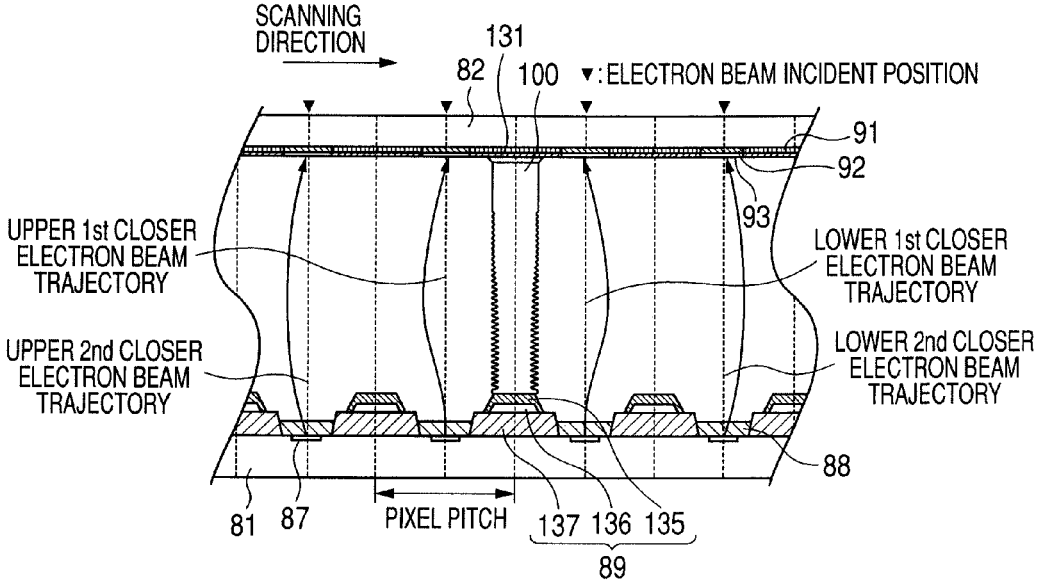
FIG. 3B is a diagram illustrating a structure near the spacer and electron beam trajectories.

As illustrated in FIGS. 2, 3A and 3B, the face plate includes a black matrix 91, phosphors 92 and a metal back 93. The black matrix is needed in order to reduce extraneous reflections in a face plate region which electron beams do not reach as well as to avoid color mixing of adjacent phosphors. The phosphors emit light to display an image when electrons are energized by collisions. The metal back, which is formed on the inner side of the phosphors, has a function to improve luminance by specularly reflecting the light from the phosphors outward as well as a function to apply an acceleration voltage needed to accelerate electrons over an entire image display area of the face plate.

Next, correction of beam position according to the present invention will be described. In FIGS. 3A and 3B, the electron-emitting devices 87 are designated as the first closest, second closest and so on in order of closeness to the spacer 100. Also, of the electron-emitting devices on both sides of the spacer, the devices which are scanned earlier—i.e., to which a voltage is applied earlier—are designated as upper devices and the devices which are scanned later are designated as lower devices. The height from a glass surface on which the electron-emitting devices are located to a surface on which the spacer abuts the Y-side wires 89 is designated as scanning wiring (Y-side wire) height. After being emitted from the electron-emitting devices, an electron beam impinges on the metal back 93 on the face plate side by being accelerated under the influence of electric fields of the spacer and matrix wirings. Some of the electrons pass through the metal back 93 to cause the phosphors 92 to emit light, and some of the electrons impinge on the spacer by being reflected by the metal back 93. The electrons which impinge on the spacer cause the spacer to be charged. Incidentally, FIG. 3A illustrates a case in which the present invention is not applied while FIG. 3B illustrates a case in which the present invention is applied.

Beam deviation is expressed in terms of percentage of pixel pitch. A deviation of 0% corresponds to a non-spacer portion and a deviation of −10% means a deviation of 10% the pixel pitch away from the spacer.

Figure 4:
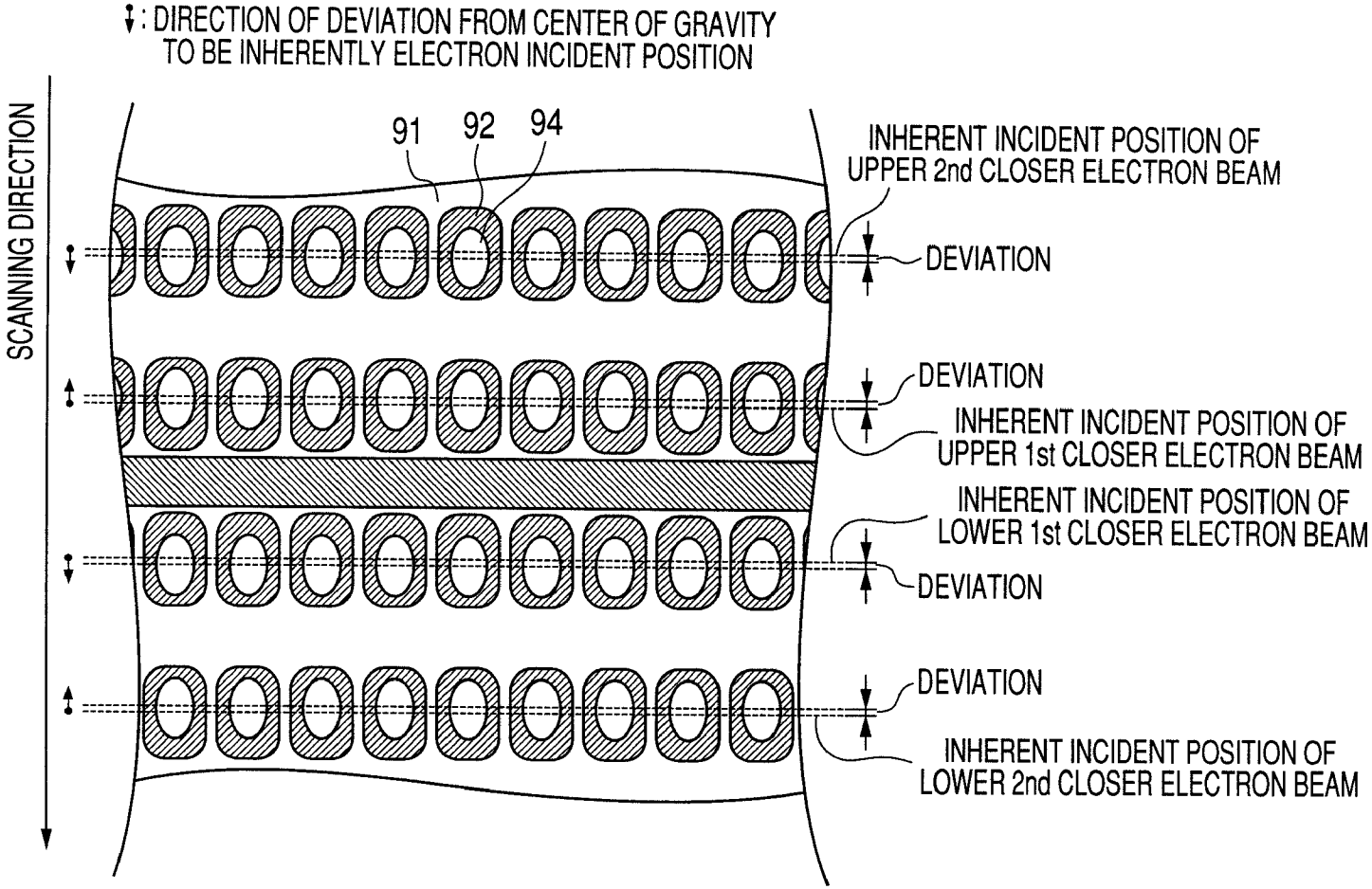
FIG. 4 is a top view of a face plate, illustrating beam deviations near the spacer.

In FIG. 4, the center of gravity of an electron beam luminescence image 94 coincides with the center of an opening of the phosphor when there is no beam deviation. In this example, since beam luminescence images of the third closest and subsequent devices are well away from the spacer, even though center of gravity position deviates more or less due to manufacturing errors in a matrix structure or due to misalignment (described later), the deviation is normally imperceptible to humans. However, the beam luminescence images near the spacer deviate uniformly, being affected by the electric field of the spacer. In FIG. 4, the beam luminescence images of the first closest device deviate in such a way as to move away from the spacer uniformly (referred to as repulsion), and the beam luminescence images of the second closest device deviate in such a way as to move toward the spacer uniformly (referred to as attraction). The beam deviations near the spacer depend on configuration rather than on the first/second or upper/lower devices.

Figure 5:
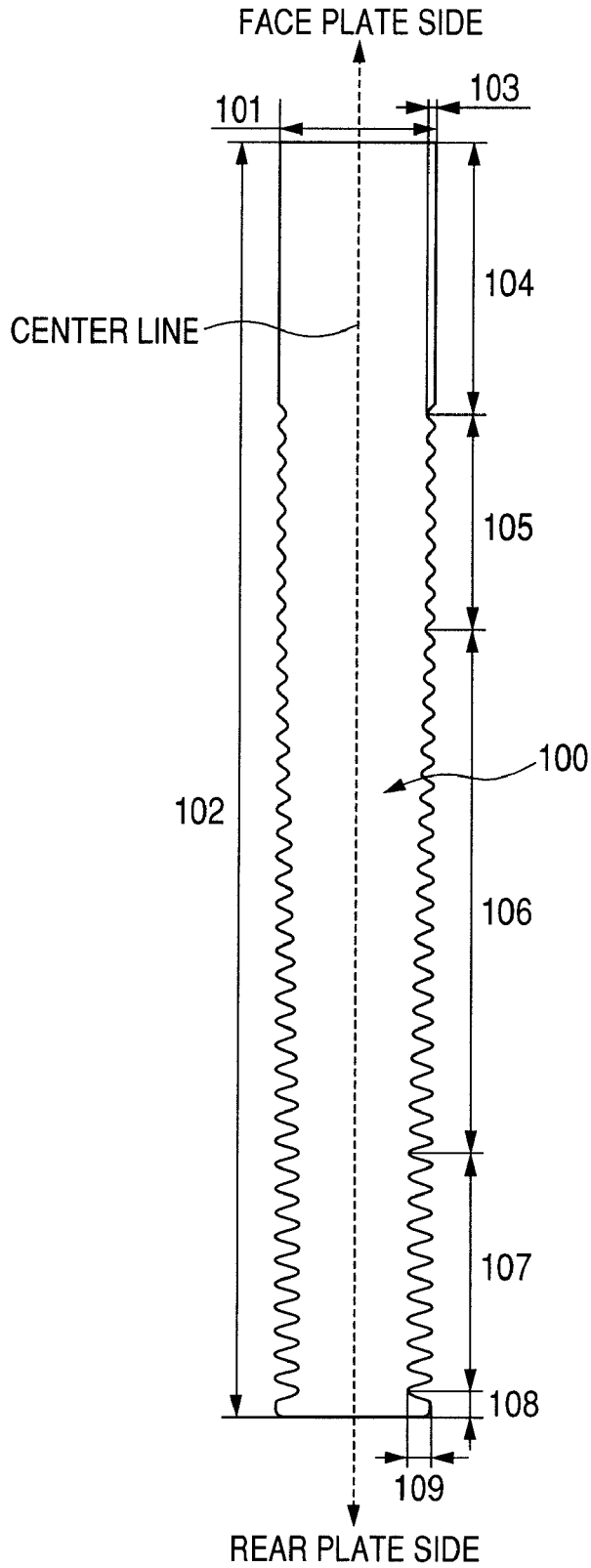
FIG. 5 is a diagram illustrating a concavo-convex pattern of the spacer and names of spacer parts.

FIG. 5 shows a concavo-convex pattern of the spacer and names of spacer parts. Length of the spacer in the thickness direction of the image display apparatus is referred to as transverse spacer length 102 and length of the spacer extending parallel to the image display area of the image display apparatus is referred to as longitudinal spacer length. Incidentally, the longitudinal spacer length is parallel to the direction in which the Y-side wires 89 extend in FIG. 2 and is perpendicular to the scanning direction in FIG. 1. Besides, thickness in the direction perpendicular to the transverse length is referred to as spacer thickness 101. The longitudinal spacer length depends on size of the image display apparatus. The spacer thickness is determined based on strength of the spacer and effects of the spacer on electron-beam trajectories. Concavo-convexity is formed on that surface (hereinafter referred to as a side face) of the spacer which is exposed between the electron-emitting devices of the rear plate and irradiated sections of the face plate. There is a flat part between a concavo-convex portion of the spacer and an end of the spacer on the rear plate side as well as between the concavo-convex portion of the spacer and an end of the spacer on the face plate side. Distance between an end face on the rear plate side and the deepest part of the first groove on the rear plate side is designated as a rear-plate-side flat-part length 108. Distance between an end face on the face plate side and the deepest part of the first groove on the face plate side is designated as a face-plate-side flat-part length 104. The concavo-convex portion is divided into three regions: a region on the rear plate side, a region on the face plate side where depth of grooves differ from that on the rear plate side, and a region where depth of grooves varies continuously between the above two regions, merging the depths of grooves in the rear-plate-side and face-plate-side regions smoothly. These regions are referred to as a rear-plate-side groove-depth region 107, face-plate-side groove-depth region 105, and transitional region 106, respectively. A trigonometric function or trapezoid is mainly used as shape of the grooves. To change the depth of grooves, the shape is subjected to linear addition or subtraction. There is no particular limit on a machining method of the concavo-convex pattern as long as a desired shape can be obtained. Possible methods include mechanical methods such as cutting and grinding and chemical methods such as photolithography plus etching. A mechanical method such as cutting or grinding and hot drawing may be used in combination as is the case with examples of the present invention.

Figure 6:
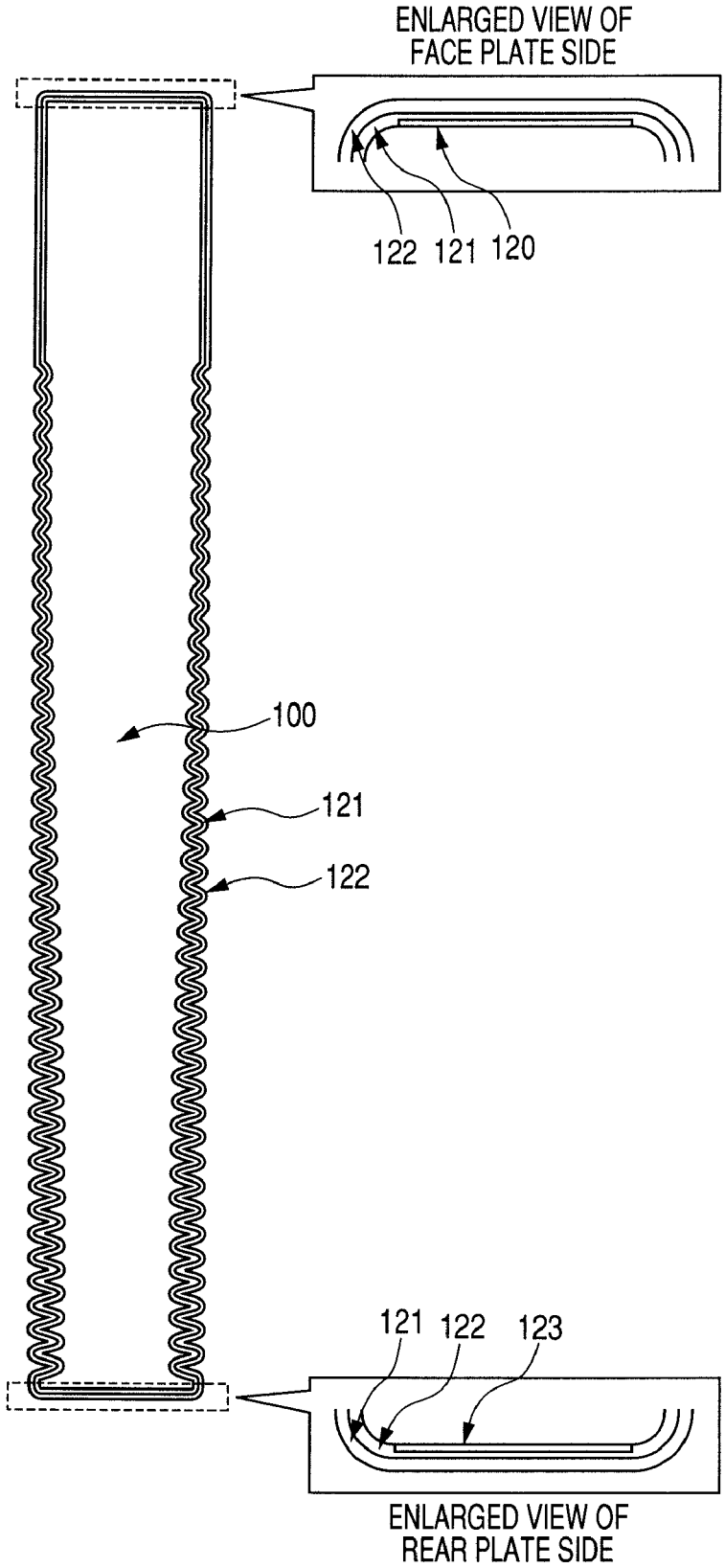
FIG. 6 is a diagram illustrating various films on the spacer.

As illustrated in FIG. 6, films with different functions are formed on the spacer surface. A rear plate side edge surface potential regulation film 123 is formed on the rear-plate-side end face to equalize potential of an entire rear-plate-side abut surface of the spacer. An electric field on the rear plate side of the spacer has a large effect on electron-beam trajectories because the electric field acts in a region where electron beams have low velocities. Thus, resistance of the film needs to be low enough to minimize changes in the potential. Value of the resistance is expressed in terms of a ratio to a high-resistance potential regulation film formed on the concavo-convex surface. Normally, it is preferable that the ratio is 1000 to 1 or larger. The low-resistance film is formed in such a way as not to jut out into the concavo-convex surface in order to avoid increased effect on electron-beam trajectories. A face plate side edge surface potential regulation film 120 is formed on the face-plate-side end face to equalize potential on the face plate side as well.

Figure 7:
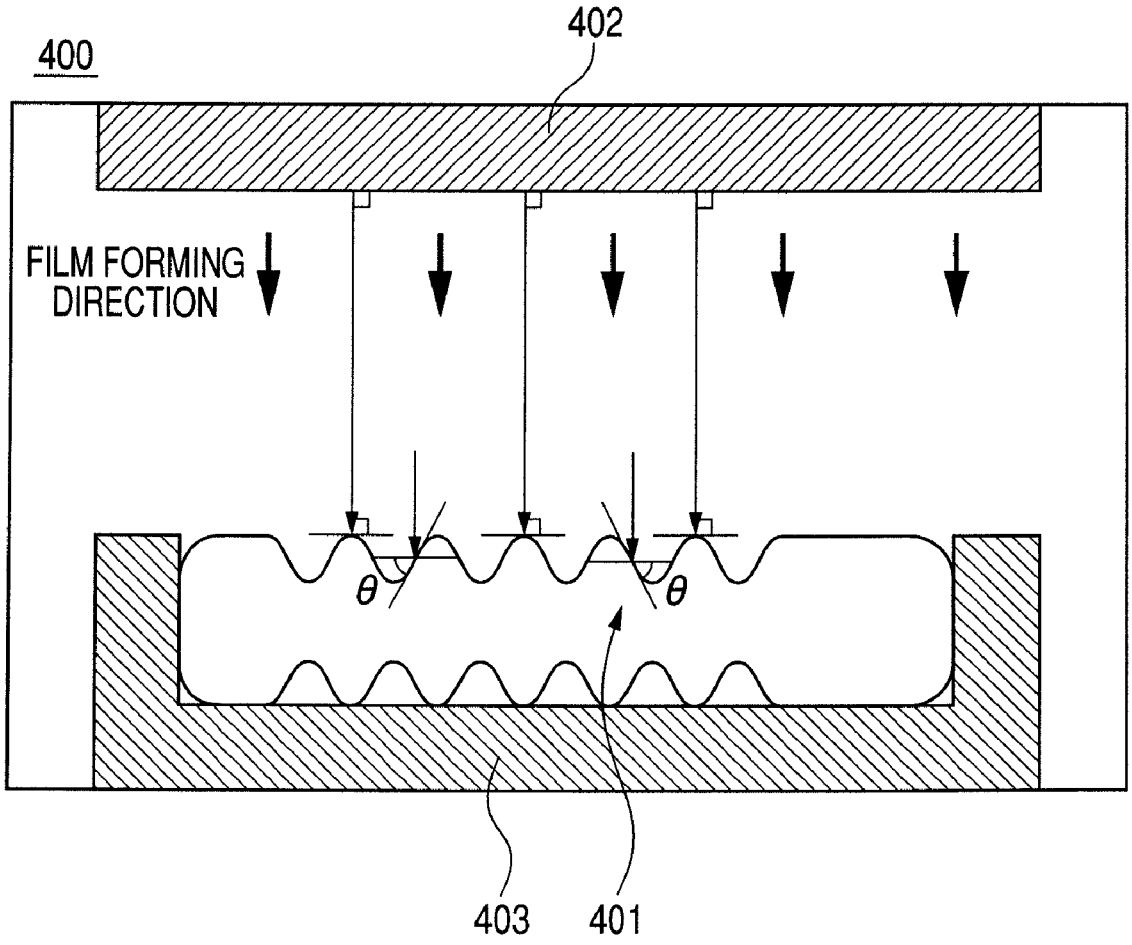
FIG. 7 is a diagram illustrating angle dependency of film formation.

After films of end face electrodes are formed, high-resistance potential regulation film 121 is formed on the side face of the spacer. FIG. 7 illustrates how the film is formed.

Next, a high-resistance antistatic film 122 is formed on the high-resistance potential regulation film. The high-resistance antistatic film has a high resistance of 100 to 1 or larger in terms of the resistance ratio in order not to affect functions of the high-resistance potential regulation film. Functions of the high-resistance antistatic film are to control the secondary electron emission coefficient by means of the electrons incident on the spacer and to protect the high-resistance potential regulation film. Therefore, the high-resistance antistatic film uses a film material with a low secondary electron emission coefficient and has a relatively large film thickness.

A typical sputtering or vapor deposition process can be used for formation of the films on the spacer surface.

The envelope of the image display apparatus is produced by a sealing process.

The envelope is driven by a drive unit to display images. The image display apparatus is driven by being scanned one to a few lines at a time in one of the X and Y directions to avoid decreases in luminance due to voltage drops. According to this embodiment, scanning is performed in the direction indicated by an arrow in FIGS. 3A, 3B and 4 (a scanning signal is input to the Y-side wires). Preferably, a scan period is short from the viewpoint of flicker reduction, but an upper limit of the scan period is determined by a time constant needed for electrons collected on the spacers to be removed through the high-resistance potential regulation film.

Figure 1:
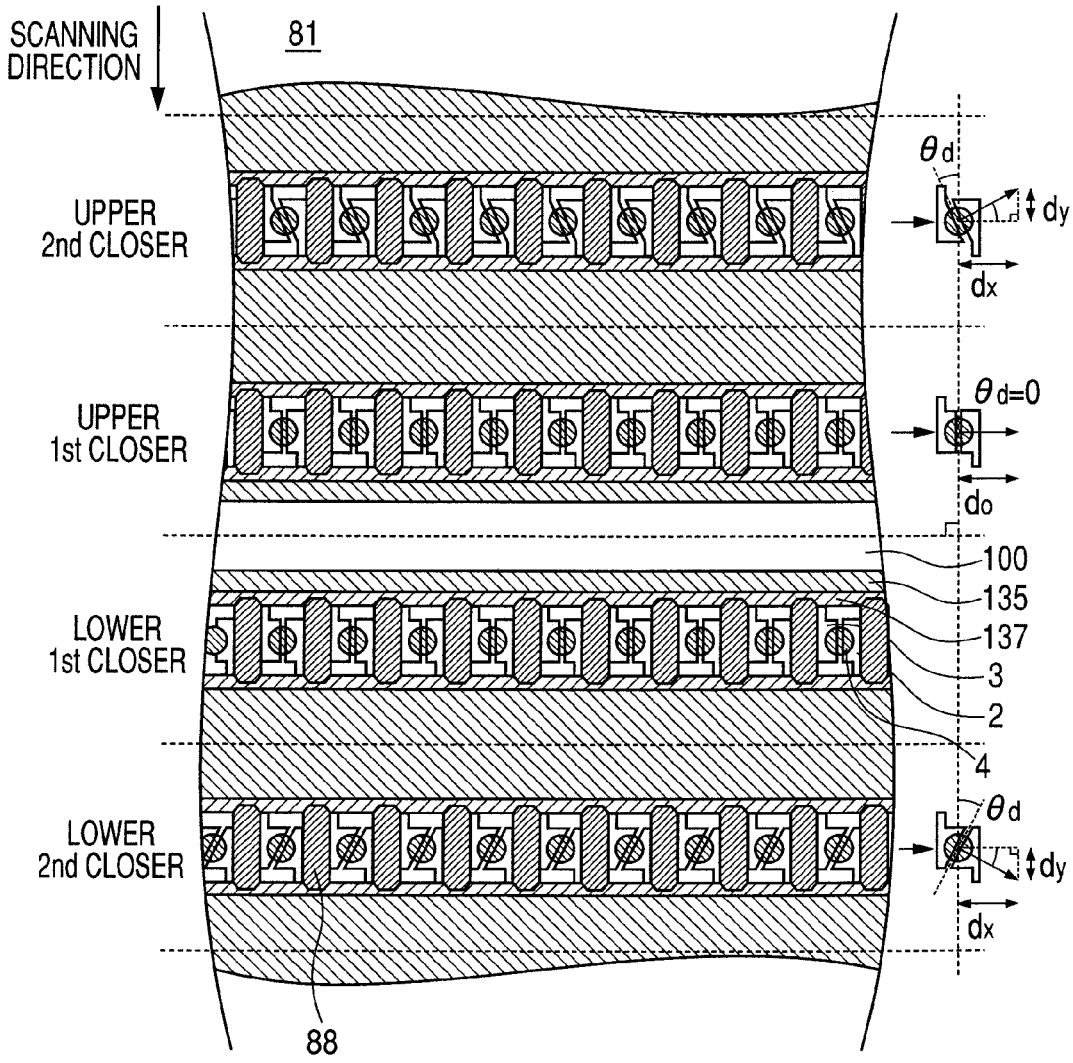
FIG. 1 is a diagram illustrating a rear plate in which inclined device electrodes are installed in the second closest devices.
Figure 8:
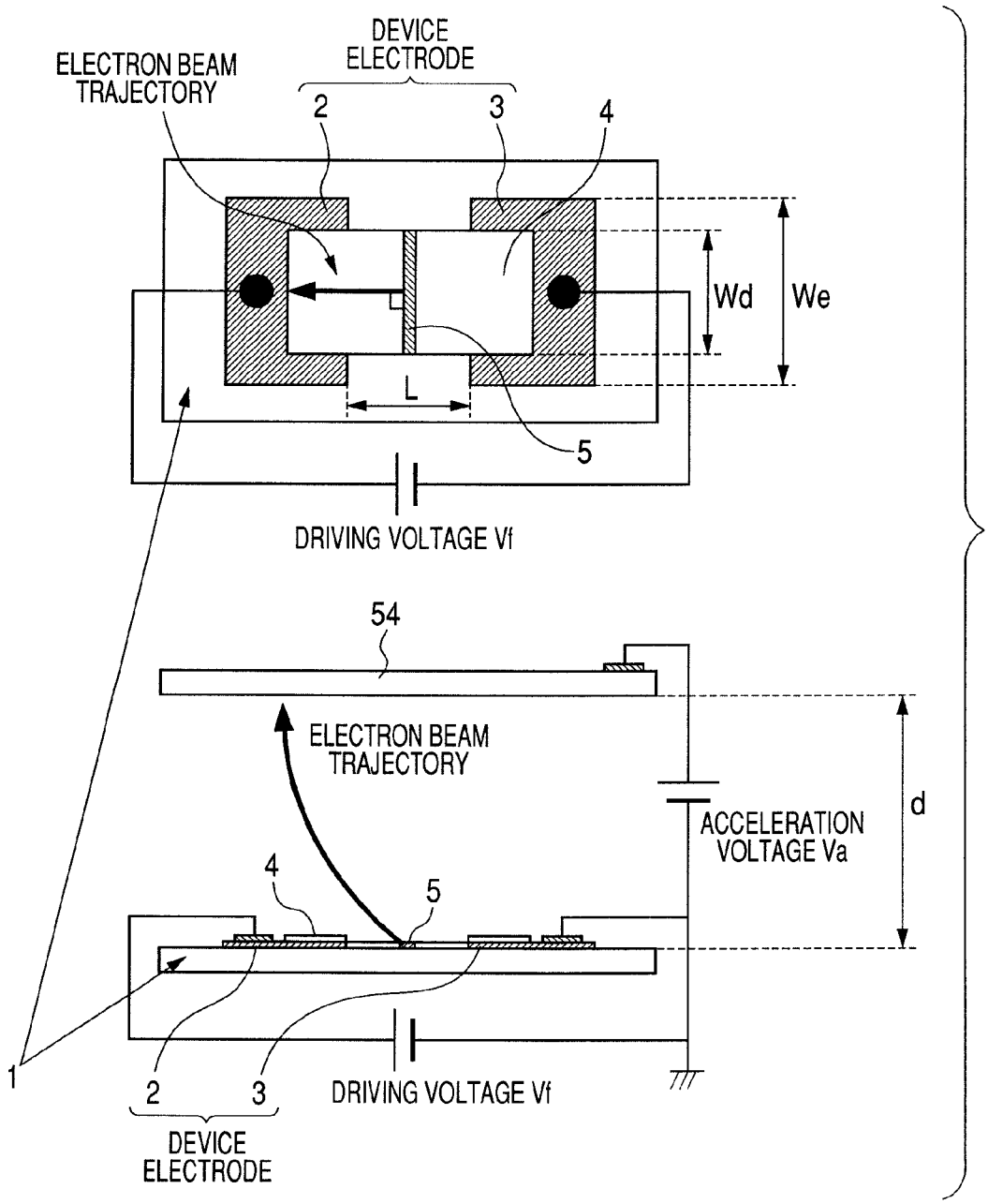
FIG. 8 is a diagram illustrating a basic structure of a surface conduction electron-emitting device.

Inclined device electrodes will be described. An arrow in FIG. 8 represents an average initial velocity vector of an electron group emitted from a surface conduction electron-emitting device. This vector results because a macroscopic electric field near an electron source is parallel to the direction in which electrodes oppose each other. The emitted electron group is accelerated by an acceleration voltage Va and reaches the irradiated section on the face plate. The distance from the electron-emitting device to the incident position in the direction parallel to the face plate is referred to as a drift distance $d_0$. As illustrated in FIG. 1, according to the present invention, opposing faces of device electrodes 3 and 2 of the electron-emitting device near the spacer are inclined at an angle of θ to a direction (scanning direction) perpendicular to the longitudinal direction of the spacer. In other words, the longitudinal direction of a gap between the device electrodes 3 and 2 is inclined at an angle of θ to a direction perpendicular to the longitudinal direction of the spacer. Incidentally, when the longitudinal direction of the gap between a pair of device electrodes is inclined with respect to the direction perpendicular to the longitudinal direction of the spacer in this way, the device electrodes will hereinafter be referred to as inclined device electrodes. If the inclination of the inclined device electrodes is $\theta_d$, an amount of beam position correction made by the inclined device electrodes is given by:

$$d_y = d_0 \times \cos(90 - \theta_d)$$

On the other hand, a difference $\Delta d_x$ in drift distance between an electron beam emitted from an electron-emitting device with inclined device electrodes and electron beam emitted from an electron-emitting device without inclined device electrodes is given by:

$$\Delta d_x = d_0 \times \{1 - \sin(90 - \theta_d)\}$$

Figure 12:
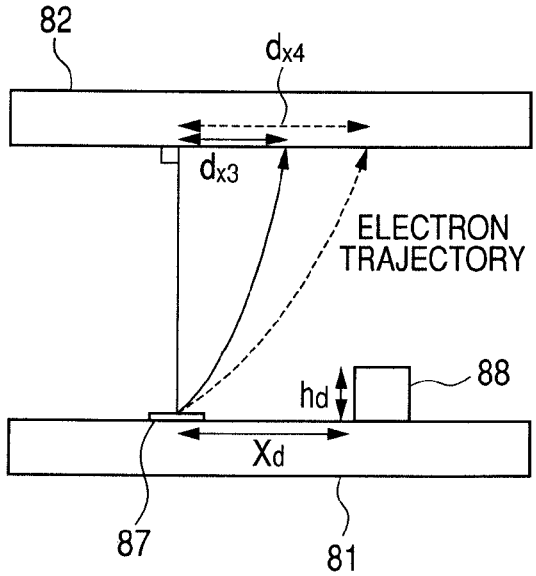
FIG. 12 is a diagram illustrating drift distances.

$\Delta d_x$ is normally 1 μm or less, which normally is negligible. Correction effect of the inclined device electrodes on the electron beam increases with increases in $d_0$ and $\theta_d$, resulting in increased practicality. However, with decreases in the pixel pitch, the device electrodes surrounded by wiring such as illustrated in FIG. 1 decreases in flexibility of layout, and consequently available values of $\theta_d$ become smaller. Also, as illustrated in FIG. 12, the drift distance is affected by the electric field of an adjacent X-side wire and the value which originally should be $d_{x4}$ reduces to $d_{x3}$. The amount of reduction depends on distance $x_d$ between the electron-emitting device and X-side wire as well as on height hd of the X-side wire. For the reasons described above, the smaller the pixel pitch, the smaller the correction effect of the inclined device electrodes on the electron-beam trajectory.

Under these circumstances, the inventors have made the present invention based on a new finding that the "second closest devices" located farther away from the spacer need more correction than the "first closest devices" located nearest to the spacer.

As described above, the present invention is based on a new finding that the electron-emitting devices which are the second closest to the spacer are affected by charging of the spacer more greatly than the electron-emitting devices closest to the spacer. Based on this finding, the inventors developed a new configuration in which the device electrodes of the second closest devices are inclined more greatly than the device electrodes of the first closest devices located nearest to the spacer. Incidentally, the reason why the second closest devices are affected more greatly by the charging of the spacer lie in charge distribution on the spacer surface and difference in surface geometry between the face plate and rear plate. That is, the reasons are that the spacer is positively charged on the face plate side and negatively charged on the rear plate side and that there are wiring and other protruding structures on the rear plate while the face plate is relatively flat. More specifically, the electron beams emitted from the first closest devices are affected by both the positive and negative charges on the spacer surface. Regarding the electron beams emitted from the second closest devices, the effect of the negative charge on the rear plate side is reduced by potential shielding of the wiring, but the positive charge on the face plate side affects the spacer directly. In this way, the second closest devices are affected unevenly by the charging of the spacer, i.e., affected more greatly by the positive charge on the face plate side. Consequently, the second closest devices are affected more greatly by the charging of the spacer than the first closest devices. Based on this new finding, the inventors provide a new configuration in which the second closest devices are inclined more greatly than the first closest devices located nearest to the spacer.

Desirable conditions in plural embodiments of the present invention will be described next.

First Embodiment

Figure 13A:
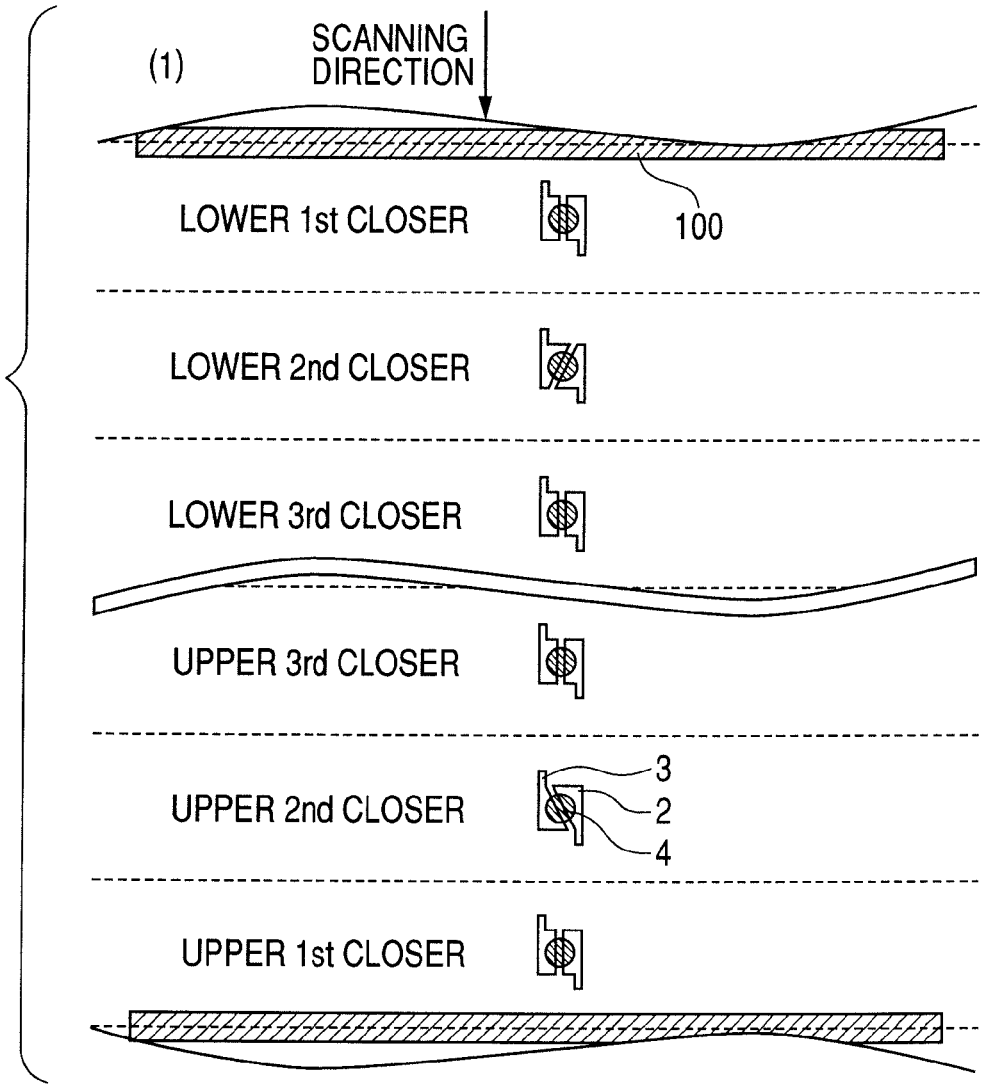
FIG. 13A is a diagram illustrating an installation example of the first and second closest inclined device electrodes.

An exemplary embodiment in which inclined device electrodes are installed only in the second closest devices will be described. This embodiment is illustrated in FIG. 13A. That is, the longitudinal direction of the gap between the device electrodes of the second closest device is inclined with respect to the direction perpendicular to the longitudinal direction of the spacer while the device electrodes of the first closest device is not inclined with respect to the direction perpendicular to the longitudinal direction of the spacer. Consequently, the inclined device electrodes of the second closest device are inclined more greatly than the device electrodes of the first closest device.

Second Embodiment

Figure 13B:
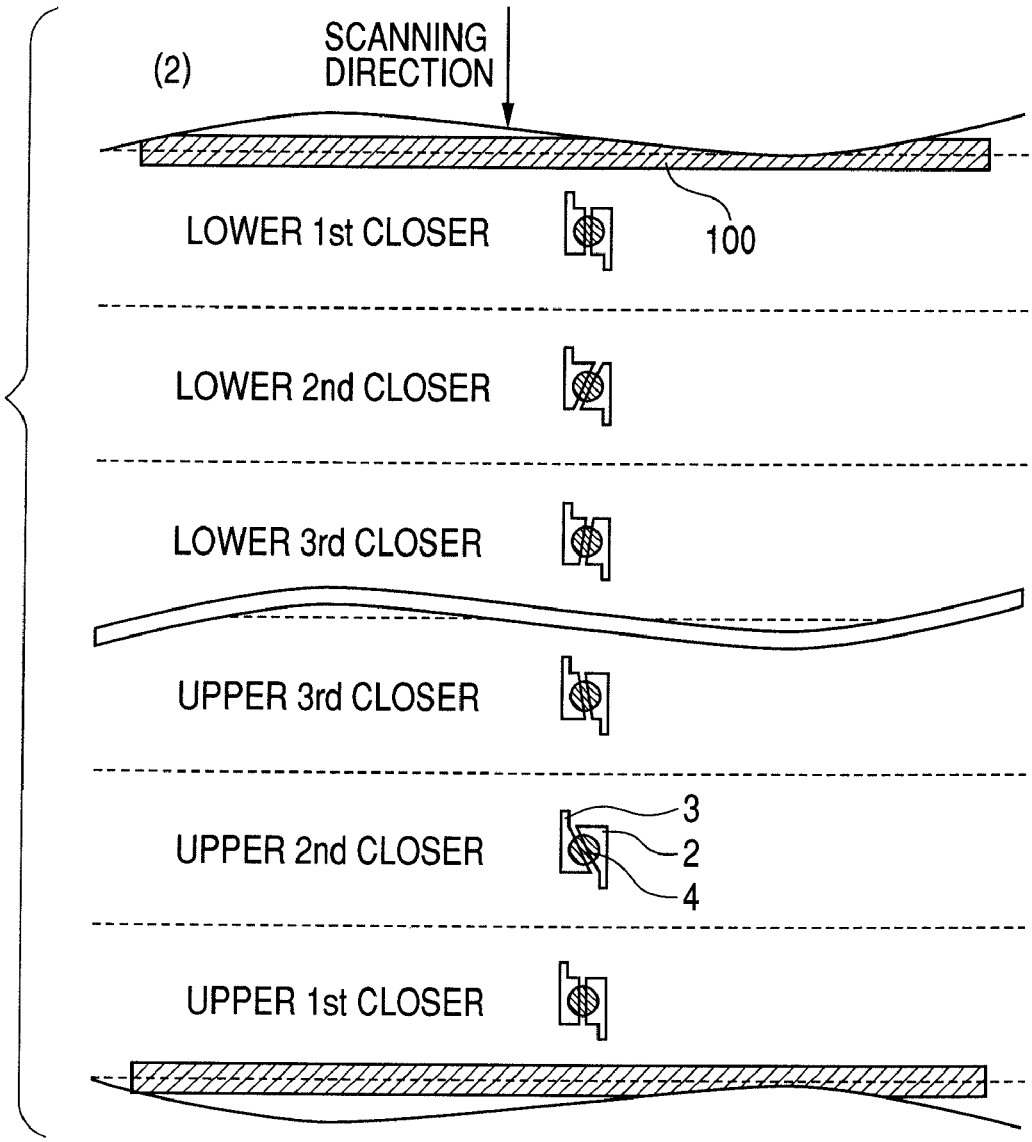
FIGS. 13B, 13C, 13D, 13E and 13F are diagrams illustrating variations of the third and subsequent closest inclined device electrodes between spacers.
Figure 13C:
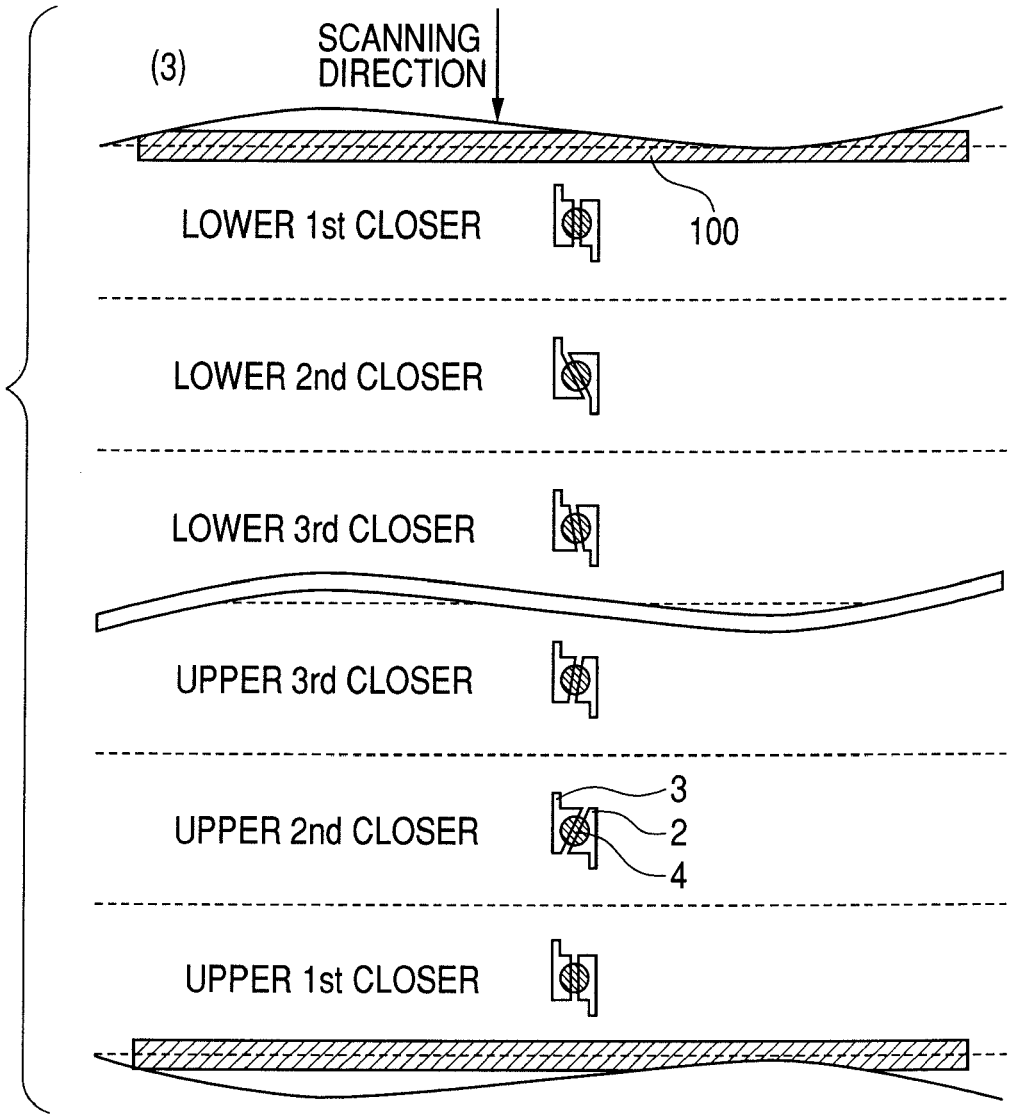
Figure 13D:
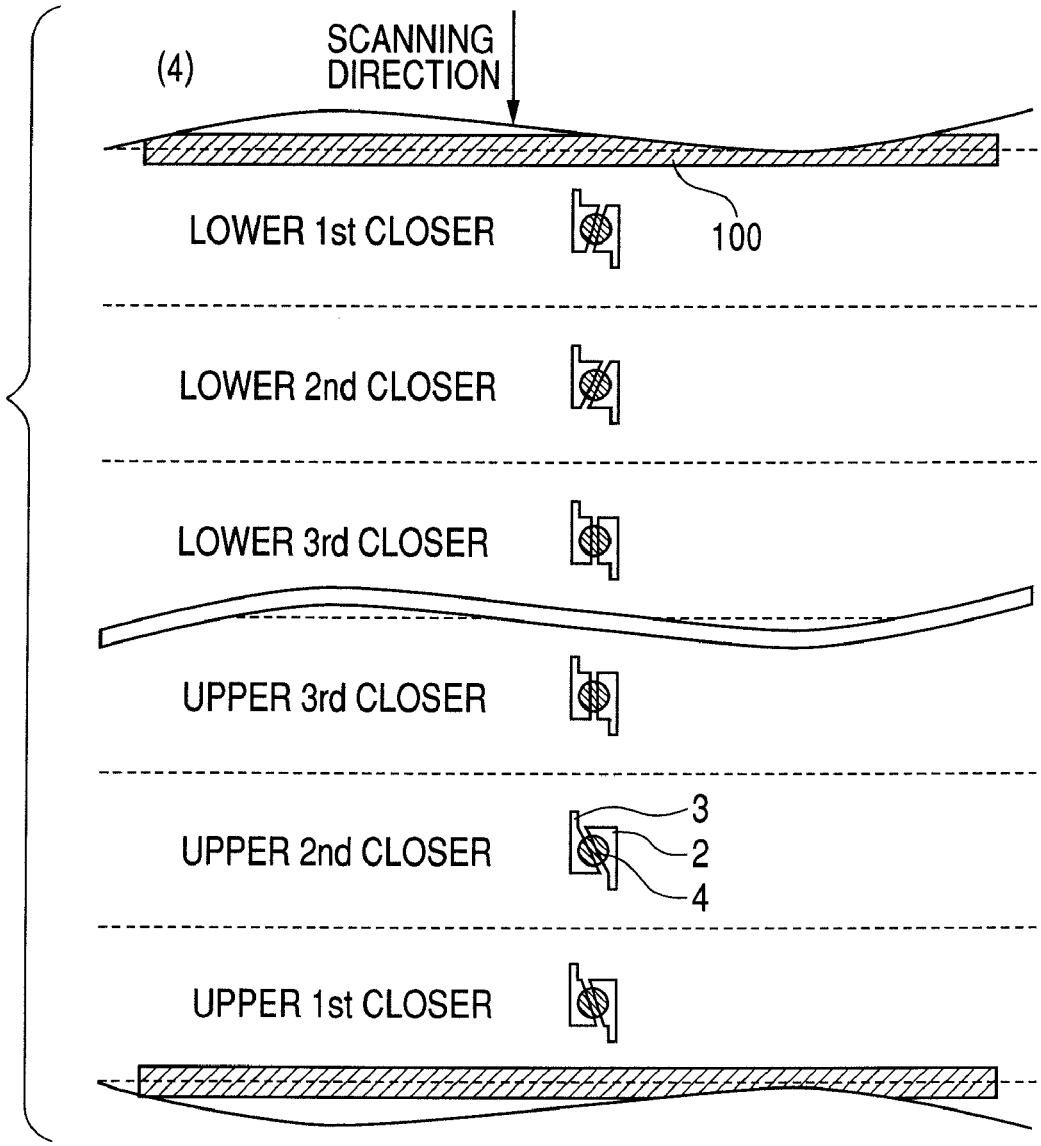
Figure 13E:
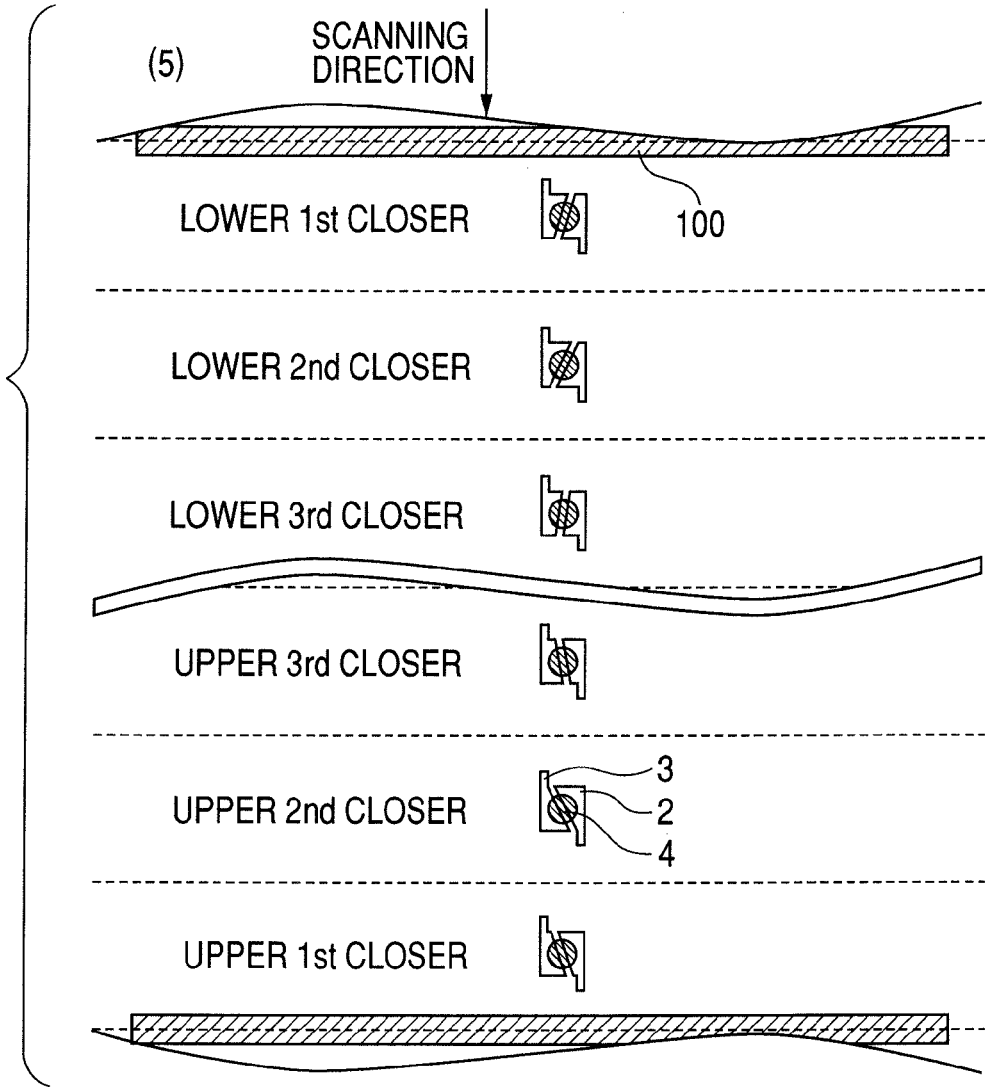
Figure 13F:
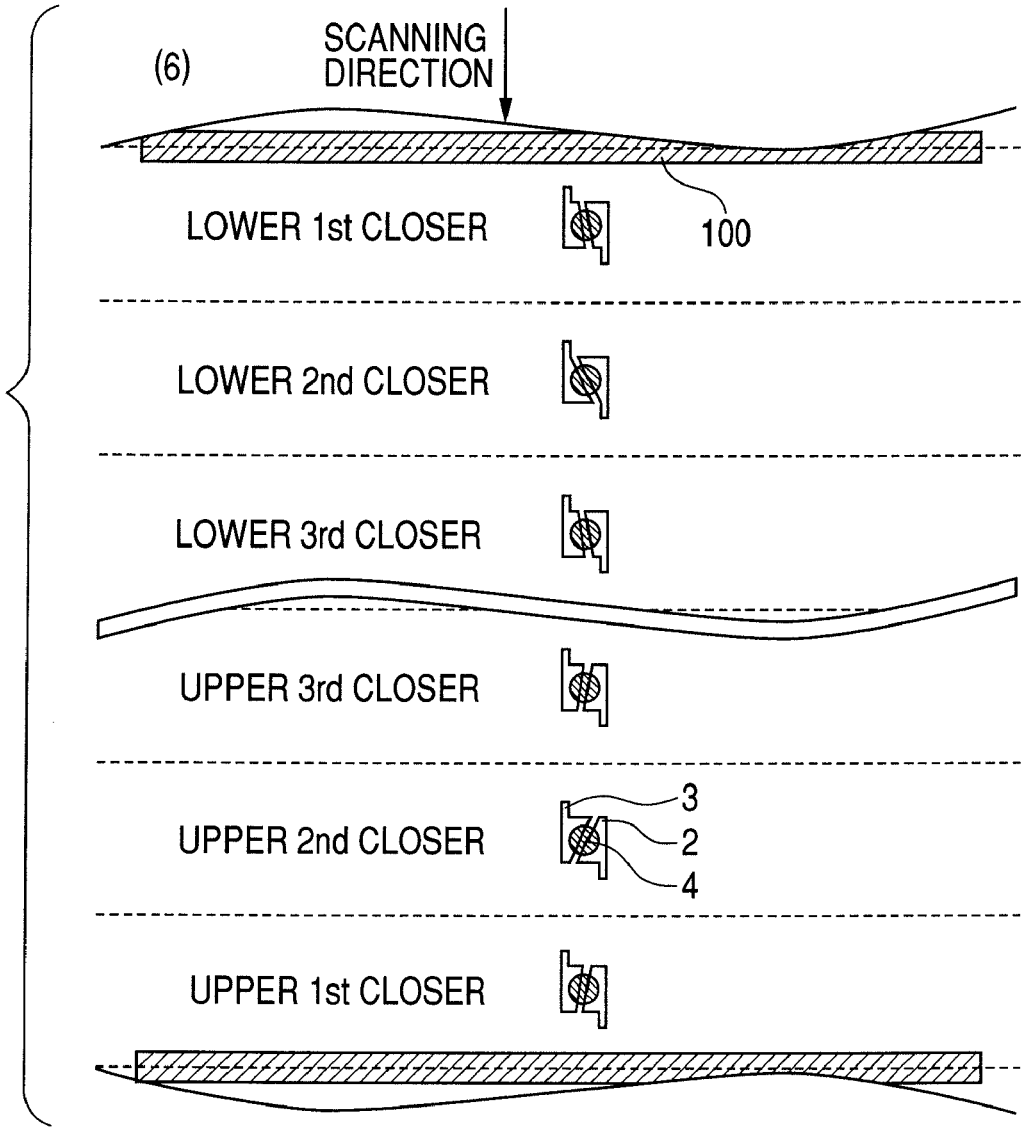

An exemplary embodiment in which inclined device electrodes are installed in the second closest device and inclined device electrodes are installed supplementarily in the first closest device will be described. This embodiment is illustrated in FIGS. 13D to 13F. That is, the longitudinal direction of the gap between the device electrodes is inclined with respect to the direction perpendicular to the longitudinal direction of the spacer in both the first and second closest devices, but the inclination is larger in the case of the second closest device than in the case of the first closest device. This configuration is used when the beam deviation of the first closest device is greater than in the first embodiment.

Third Embodiment

An exemplary embodiment in which inclined device electrodes are installed not only in the first and second closest devices, but also in the third closest and subsequent devices will be described. This embodiment is illustrated in FIGS. 13B, 13C, 13E and 13F. This configuration is used when deviation in the beam incident position of the first closest device is too great to be corrected by the first or second embodiment.

EXAMPLES

Example 1

Examples of the image display apparatus according to the present invention will be described.

FIG. 2 is a perspective view of the image display apparatus, partially cut away to show an internal structure. Also, an enlarged sectional view of a sealed portion of the image display apparatus is shown in a dotted box below the perspective view. As illustrated in FIG. 2, the image display apparatus according to this example includes a rear plate 81, face plate 82 placed opposite the rear plate, and support frame 86 for supporting the plates, all of which make up an envelope 90. In the rear plate 81, a large number of electron-emitting devices 87 which are surface conduction electron-emitting devices in this case are arranged in a matrix. A pair of device electrodes in each surface conduction electron-emitting devices 87 are connected to an X-side wire 88 and Y-side wire 89. According to this example, the X-side and Y-side wires are made mainly of silver (Ag). The X-side and Y-side wires are insulated by an interlayer insulating layer (not shown) made mainly of lead oxide (PbO). The X-side and Y-side wires and interlayer insulating layer make up a three-dimensional structure and affect electron-beam trajectories in no small measure. The face plate 82 is made up of a glass substrate 83. Phosphors 92 and a metal back 93 are formed on an inner wall of the glass substrate 83. Since a high vacuum is maintained between the face plate 82 and rear plate 81, a spacer 100 is placed on the Y-side wires which are scanning wirings, to protect an inner vacuum region from atmospheric pressure.

FIG. 3B is a sectional view of a portion near the spacer of the image display apparatus. The spacer 100 is installed between the face plate 82 and rear plate 81. The spacer abuts a face-plate-side abutting member 131 and the Y-side wires 89.

According to this example, the electron-emitting devices installed on the rear plate 81 are surface conduction electron-emitting devices.

Basic device configuration of a surface conduction electron-emitting device will be described. FIG. 8 is a top view and side view of the device configuration, respectively. As illustrated in FIG. 8, the surface conduction electron-emitting device includes a pair of device electrodes 2 and 3 formed on a substrate 1, where device electrode spacing is L and device electrode length is We. The longitudinal direction of the gap between the device electrodes 2 and 3, which are inclined device electrodes in this example, is inclined at an angle of θ to the direction perpendicular to the longitudinal direction of the spacer. Furthermore, a conductive thin film 4 is formed, bridging the device electrodes 2 and 3, and an electron-emitting section 5 is formed near the center of the conductive thin film 4. An anode is installed opposite the substrate 1 and the opposing face is coated with phosphors.

According to this example, non-alkali glass is used for the substrate 1. The device electrodes 2 and 3 are made of conductive material, namely titanium (Ti) and platinum (Pt) in this example. Film thickness depends on conductivity of the material, and is approximately 45 nm according to this example. The device electrode spacing L is approximately 10

μm, device electrode length We is approximately 120 μm, and device length Wd is approximately 60 μm. The device electrodes 2 and 3 are formed using a combination of sputtering and photolithography. Consequently, patterning of inclined device electrodes involves no difficulty.

A particulate film made of particulates is used as the conductive thin film 4 to obtain good electron-emission characteristics. Film thickness of the conductive thin film 4 is approximately 10 nm. The conductive thin film is made of Pd in this example. The conductive thin film 4 is formed by baking after application of a solution.

The electron-emitting section 5 is formed by the application of voltage in a process known as forming after the conductive thin film 4 is formed. According to this example, after application of an organic palladium solution, a palladium oxide (PdO) film is formed by baking, thereby forming the conductive thin film 4. Then, the palladium oxide (PdO) film is reduced into a palladium (Pd) film by the application of voltage at high temperatures in a reduction atmosphere in which hydrogen coexists. At the same time, cracks are formed to produce the electron-emitting section 5. Normally, the voltage applied is approximately 20V. Next, a process called activation is performed to increase an electron-emission efficiency. A gas containing carbon is introduced under vacuum to deposit a carbon film near the cracks in the electron source. According to this example, trinitrile was used as a carbon source.

Figure 9:
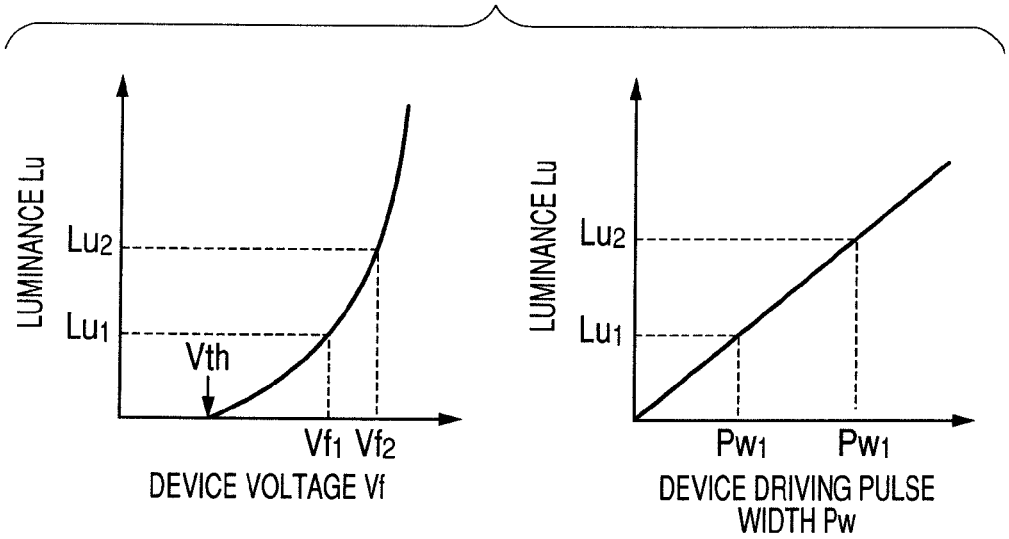
FIG. 9 is a diagram illustrating basic characteristics of the surface conduction electron-emitting device.

The surface conduction electron-emitting device configured as described above applies voltage between the pair of device electrodes 2 and 3, passing current (emission current) through a surface (device surface) of the conductive thin film 4, and thereby discharges electrons from near the cracks in the electron-emitting section 5. Being accelerated by an anode electrode to which a voltage of approximately 12 kV is applied, the discharged electrons impinge on phosphor on the anode and thereby emit light. The electron-emitting device has characteristics such as illustrated in FIG. 9, i.e., switching characteristics according to which when a driving voltage Vf exceeds a threshold voltage Vth, the emission current increases exponentially, increasing emission luminance of the anode-side phosphor. The threshold voltage Vth is approximately 10 V and the driving voltage Vf is approximately 19 V. The device is driven by rectangular pulses on an alternating basis and the luminance increases with increases in pulse width Pw. The pulse width Pw, which is 0 to approximately 12 μsec, represents gradations.

Next, fabrication of a rear plate which has a plurality of electron sources will be described. First, a film of titanium (Ti) is formed as a primary coat on an electron source substrate to a film thickness of 5 nm and a film of platinum (Pt) is formed to a film thickness of 40 nm on the titanium film by sputtering. Device electrodes are formed by patterning using photolithography. Next, sliver (Ag) photo paste is screen-printed, dried, exposed and developed. Then, the sliver photo paste is baked at approximately 480° C. to form the X-side wires which are modulation wirings. The modulation wirings are designed to be approximately 8 μm high and approximately 45 μm wide after the baking. Next, photo paste composed principally of lead oxide (PbO) is screen-printed, dried, exposed and developed. This provides an interlayer insulating layer intended to protect the X-side wires and insulate the X-side and Y-side wires from each other. The X-side wires are approximately 60 μm wide and approximately 16 μm high including the insulating layer. The insulating layer under the Y-side wires is approximately 435 μm wide and approximately 25 μm high. Contact holes are provided in the interlayer insulating layer under the Y-side wires to enable electrical contact with the underlying electrodes installed in the previous process. Next, the Y-side wires are formed on the insulating layer. Photo paste composed principally of lead oxide (PbO) is screen-printed, dried, exposed and developed, thereby forming the Y-side wires on the insulating layer of the Y-side wires. The Y-side wires which serve as scanning wirings are 400 μm wide and 35 μm high. According to this example, as illustrated in FIG. 3B, the Y-side wires have a two-layer structure to increase their height dimension. When the above process is finished, the electron source substrate is washed thoroughly, surfaces of the electron source substrate are treated with a solution containing volatile substances to make the surfaces of the electron source substrate hydrophobic. Next, a solution composed principally of organic palladium is applied between the device electrodes by an inkjet process. At this time, a thin film with an appropriate area and thickness is formed on the device electrodes because of the foregoing hydrophobic treatment. According to this example, Wd was 60 μm. Subsequent baking produces a conductive thin film composed principally of palladium oxide (PdO) described above. Subsequently, the rear plate was formed through the forming and activation processes described above.

FIG. 4 is a top view of electron beam luminescence images 94 on the face plate 82 of the image display apparatus illustrated in FIG. 2. The face plate 82 includes a black matrix 91 and phosphors 92. After black stripes are formed on a glass surface by screen printing, the phosphors are dropped and printed. Then, aluminum (Al) is deposited as a metal back. The black stripes prevent color mixing and reduction in contract due to extraneous reflections. The metal back has a function to improve luminance by specularly reflecting inward-directed light from the phosphors outward as well as a function of an anode electrode to apply an acceleration voltage needed to accelerate electrons.

Figure 10:
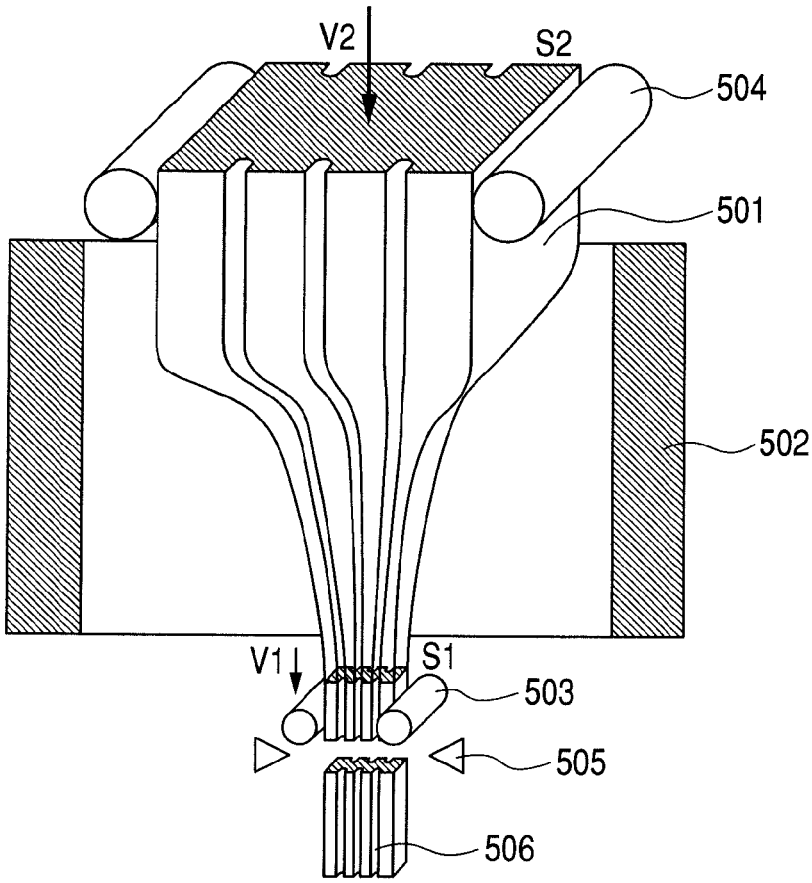
FIG. 10 is a diagram illustrating a hot drawing process of the spacer.

A fabrication process of the spacer will be described. Base material of the spacer is produced using a hot drawing machine illustrated in FIG. 10. First, a concavo-convex pattern is formed on a surface of an insulating base material by cutting. The insulating base material used in this example is PD200 manufactured by Asahi Glass CO., LTD. Cross-sectional shape of the insulating base material including concavo-convexity is constructed so as to be similar to required cross-sectional shape of the spacer. A resulting product is referred to as a base material 501 of the spacer. With the base material 501 fixed at both ends, part of the base material 501 in the longitudinal direction is heated to temperatures at and above a softening point by a heater 502. According to this example, the temperatures are 500 to 700° C. Subsequently, the base material 501 is fed in the direction of the heated end at a velocity of V2 and drawn out from the opposite side of the heater 502 at a velocity of V1. A cross-sectional area S2 before entry into the heater 502 and a cross-sectional area S1 after exit from the heater 502 are designed to satisfy the relationship S2×V2=S1×V1. In particular, the cross sections before entry and after exit are designed to be similar to each other. The stretched base material is cut to a desired length. A diamond cutter, laser cutter, or the like is used for cutting. According to this example, dimensions of various parts of the spacer 506 before film formation, when illustrated in comparison to FIG. 5, are as follows: thickness 101 of the spacer is 195 μm, length 102 of the spacer is 1600 μm, length of a flat part on the face plate side is 337 μm, and length of a flat part on the rear plate side is 33 μm. There are 42 grooves in total and groove pitch is 30 μm. There are eight grooves on the face plate side and depth of the grooves is 10.5 μm. There are ten grooves on the rear plate side and the depth of the grooves is 12.5 μm. There are 24 grooves in the transitional region 106 where the depth of the grooves changes linearly from the rear-plate-side groove depth to the face-plate-side groove depth. Actual dimensions of the spacer are measured using a surface roughness measuring instrument (SV-3000 manufactured by Mitutoyo Corporation).

Next, a low-resistance potential regulation film is formed by sputtering on end faces of the spacer 506 before film formation. On the face plate side, gold (Au) and aluminum (Al) were sputtered, thereby forming a film of a compound of gold (Au), aluminum (Al), oxygen (O) and nitrogen (N). Film thickness is 0.1 μm. A 5-nm thick tungsten (W) film is formed on the rear plate side.

Next, gold (Au) and aluminum (Al) were sputtered on the spacer surface, thereby forming a film of a compound of gold (Au), aluminum (Al), oxygen (O) and nitrogen (N) as a high-resistance potential regulation film. The compound has a sheet resistance of approximately 1E+11 (Ω/ ) and a film thickness of 0.1 μm.

Furthermore, tungsten (W) and germanium (Ge) were sputtered on the high-resistance potential regulation film, thereby forming a film of a compound of tungsten (W), germanium (Ge), oxygen (O) and nitrogen (N) as a high-resistance antistatic film. The compound has a sheet resistance of approximately 1E+14 (Ω/) and a film thickness of 1 μm.

The spacer thus produced has a surface film composition such as illustrated in FIG. 6. There are low-resistance abut surface potential regulation films on the face-plate-side end face and rear-plate-side end face. The spacer is surrounded by the high-resistance potential regulation film over the low-resistance abut surface potential regulation films. Then, the high-resistance potential regulation film is covered with the high-resistance antistatic film. The films have sufficient adhesion to their respective immediately underlying films, but the components function separately without being mixed.

The rear plate, face plate, spacers and support frame described above make up the envelope 90 of the image display apparatus illustrated in FIG. 2. First, by stretching both longitudinal ends by a preset force on the rear plate, the spacers are installed on the scanning wirings and both the longitudinal ends are fastened with adhesive. Sealing structure of the envelope 90 will be described by referring to the part enclosed in the dotted box in FIG. 2. The support frame 86 and rear plate are fastened together by fritted glass. The support frame 86 and face plate 82 are bonded by a joining member 206. Possible materials of the joining member 206 include materials which are soft enough to absorb difference in the coefficient of thermal expansion between the rear plate 81 and face plate 82 and which do not release much gas even at high temperatures. Indium (In) is used in this example. To a portion where the support frame 86 and face plate 82 are bonded by the joining member 206, a primary coat 204 is applied to increase adhesion at an interface. In this example, silver (Ag) which has good wettability with respect to indium (In) is used.

When sealing the envelope 90, since phosphors of different colors need to be matched to electron-emitting devices, it is necessary to make alignment sufficiently by jogging the upper and lower substrates.

Because of the above-described basic characteristics of the surface conduction electron-emitting devices according to this example, the electron-emission characteristics are controlled for half-toning by an amplitude and width of pulsed voltage which is applied between opposing device electrodes. When a large number of electron-emitting devices are arranged, wirings are selected by a scanning line signal and the pulsed voltage is applied to individual devices through information signal wirings (X-side wires), allowing separate voltages to be applied to any desired devices and thereby allowing the individual devices to be controlled independently.

Figure 11:
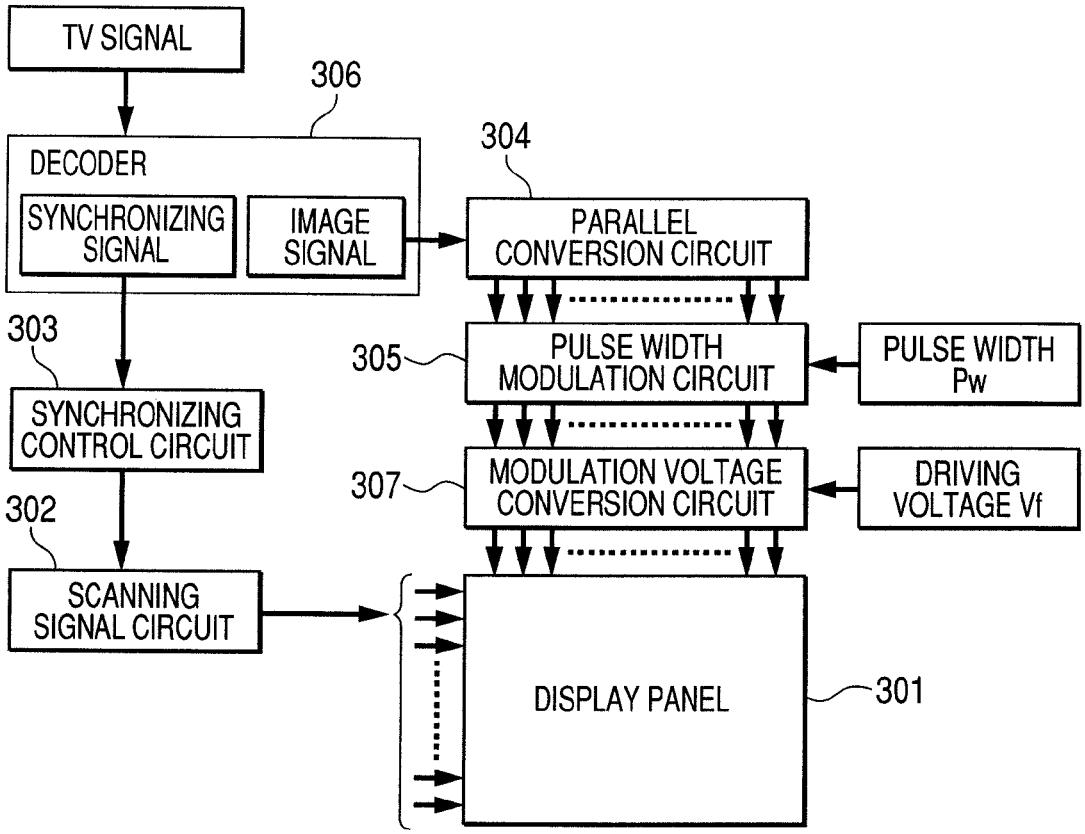
FIG. 11 is a diagram illustrating a driving system of the image display apparatus.

A standard drive unit of the image display apparatus will be described. A block diagram in FIG. 11 outlines a configuration of an image display apparatus according to this example, where the image display apparatus is intended for television display based on television signals.

The Y-side wires of an image display panel 301 which uses electron-emitting devices are connected with a scanning signal circuit 302 of a scanning drive circuit which applies a scanning line signal. On the other hand, the X-side wires are connected with a modulation voltage conversion circuit 307 and pulse width modulation circuit 305 of a data drive circuit which applies an information signal. For voltage modulation, the amplitude of input voltage pulses is appropriately modulated. For pulse width modulation, the width of voltage pulses of an input parallel image signal is modulated.

A synchronizing control circuit 303 sends out a synchronizing control signal based on a synchronizing signal received from a decoder 306. The decoder 306 is a circuit which separates synchronizing signal components and image signal components from external input television signals. The image signal components are input in a parallel conversion circuit 304 in synchronization with the synchronizing signal.

The parallel conversion circuit 304 has its operation controlled based a signal from the synchronizing control circuit 303 and performs a serial-to-parallel conversion on the image signal in chronological order as the image signal is input serially. The image signal subjected to the serial-to-parallel conversion is output as parallel signals for n electron-emitting devices.

As described above, according to this example, electron-emitting devices release electrons when voltage is applied via the X and Y wires in the image display apparatus. Also, the image display apparatus applies high voltage to the metal back, which is an anode electrode, via a high-voltage terminal Hv, thereby accelerates the electrons released from the electron-emitting devices, and thereby causes the electrons to impinge on the phosphors to display images. The image display apparatus configured as described herein is only an example of the image display apparatus according to the present invention, and various modifications can be made based on the technical ideas of the present invention. Possible input signals include NTSC, PAL and HDTV.

Beam position correction according to this example will be described. According to this example, the combined height of the insulating layer and scanning wirings (Y-side wires) is 75 μm and the pixel pitch is 630 μm, as described above. The distance between the spacer and center of the first closest electron source is 215 μm. Also, since the first closest devices are corrected appropriately by spacer shape as described above, inclined device electrodes are installed only in the second closest devices (FIG. 13A). To correct the second closest devices 0.51% in the direction away from the spacer, the angle θ was set to 1.9 degrees. That is, the device electrodes of the second closest devices were formed in such a way that the longitudinal direction of the gap between the device electrodes would be inclined at an angle of 1.9 degrees to the direction perpendicular to the longitudinal direction of the spacer. On the other hand, the device electrodes of the devices other than the second closest devices were formed in such a way that the longitudinal direction of the gap between the device electrodes would be parallel to the direction perpendicular to the longitudinal direction of the spacer. This resulted in an image display apparatus free from deviation in the beam incident position of both the first closest and second closest devices.

Example 2

This example differs from example 1 in that the total height of the insulating layer and scanning wirings is 45 μm. The distance between the spacer and center of the first closest electron source is 215 μm. Consequently, the beam position of the first closest devices is attracted 0.43%. The beam incident position of the second closest devices is the same as in example 1. Thus, the deviation in the beam incident position of the first closest devices was corrected in the direction away from the spacer (FIG. 13D). That is, the device electrodes of both the first closest and second closest devices were formed in such a way that the longitudinal direction of the gap between the device electrodes would be inclined with respect to the direction perpendicular to the longitudinal direction of the spacer. That is, the device electrodes of the first closest devices were formed in such a way that the longitudinal direction of the gap between the device electrodes would be inclined at an angle of 1.6 degrees to the direction perpendicular to the longitudinal direction of the spacer. In so doing, the second closest devices were inclined more greatly than the first closest devices. This resulted in an image display apparatus free from deviation in the beam incident position of both the first closest and second closest devices.

Example 3

This example differs from example 1 in that the pixel pitch is 483 μm, that the thickness of the spacer is 160 μm and that the distance between the spacer and first closest devices is 161.5 μm. Inclined device electrodes are not used in the first closest devices. On the other hand, inclined device electrodes are inclined 3.0 and 1.5 degrees away from the spacer in the second closest and third closest devices, respectively (FIG. 13B). This example produced an image display apparatus free of degradation in image quality.

Thus, by combining a spacer which has a concavo-convex pattern and high-resistance films on the surface with inclined device electrodes according to their features, it is possible to implement a higher-quality image display apparatus free from beam deviation.

Figure 14:
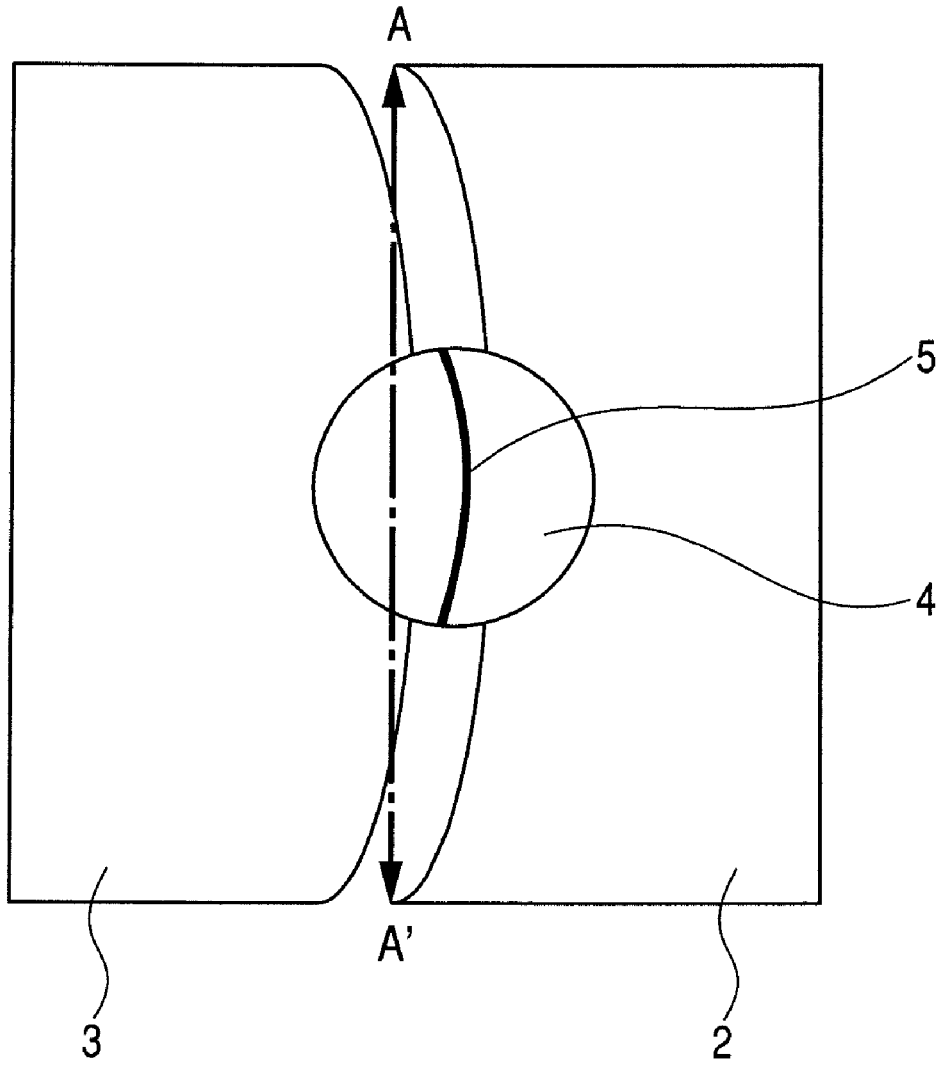
FIG. 14 shows a configuration of a pair of device electrodes of the electron-emitting device.

Incidentally, the longitudinal direction of the gap between a pair of device electrodes, as referred to herein, means the direction of a straight line joining opposite ends of the gap. Thus, for example, if the pair of device electrodes are shaped as illustrated in FIG. 14, the longitudinal direction of the gap between the pair of device electrodes coincides with the direction in which line segment A-A' extends. Incidentally, the device electrodes are denoted by 2 and 3, conductive film is denoted by 4, and electron-emitting section is denoted by 5, as in the case of the other drawings described above.

The present invention can implement a higher-quality image display apparatus by correcting differences in beam incident position resulting from differences in spacing distance from the spacer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2006-352357, filed Dec. 27, 2006, and No. 2007-304424, filed Nov. 26, 2007, which are hereby incorporated by reference herein in their entirety.

What is claimed is:

1. An image display apparatus comprising:

a rear plate including thereon first and second electron-emitting devices each having a pair of device electrodes disposed in opposition to each other sandwiching a gap therebetween, and an electron-emitting region between the pair of device electrodes;

a face plate having a phosphor; and a plate shaped spacer disposed between the rear plate and the face plate, closer to the first electron-emitting device than the second electron-emitting device, wherein a longitudinal direction of the gap of the first electron-emitting device is inclined at a first inclination angle to a direction perpendicular to a longitudinal direction of the spacer, a longitudinal direction of the gap of the second electron-emitting device is inclined at a second inclination angle to the direction perpendicular to the longitudinal direction of the spacer, and the second inclination angle is larger than the first inclination angle.

2. The image display apparatus according to claim 1, wherein the first inclination angle is zero.

3. The image display apparatus according to claim 1, further comprising a third electron-emitting device having a pair of device electrodes disposed in opposition to each other sandwiching a gap therebetween, and an electron-emitting region between the pair of device electrodes, and being disposed not closer to the spacer than the second electron-emitting device, wherein a longitudinal direction of the gap of the third electron-emitting device is inclined at a third inclination angle to the direction perpendicular to the longitudinal direction of the spacer, and the third inclination angle is smaller than the second inclination angle.

* * * * *